US007121171B2

(12) United States Patent
Hsien

(10) Patent No.: US 7,121,171 B2
(45) Date of Patent: Oct. 17, 2006

(54) RATCHET CONTROL STRUCTURE OF BIDIRECTIONAL RATCHET SPANNER

(76) Inventor: Chih-Ching Hsien, 235 Chung-Ho Box 8-24, Taipei (TW)

( * ) Notice: Subject to any disclaimer, the term of this patent is extended or adjusted under 35 U.S.C. 154(b) by 138 days.

(21) Appl. No.: 10/912,688

(22) Filed: Aug. 6, 2004

(65) Prior Publication Data

US 2006/0027050 A1 Feb. 9, 2006

(51) Int. Cl.
*B25B 13/46* (2006.01)

(52) U.S. Cl. ..... 81/63.2; 81/60; 81/63

(58) Field of Classification Search ..... 81/63, 81/63.2, 60, 61, 62, 63.1
See application file for complete search history.

(56) References Cited

U.S. PATENT DOCUMENTS 4,336,728 A * 6/1982 Deibert ..... 81/62
5,957,009 A * 9/1999 McCann ..... 81/63.2
6,516,691 B1 * 2/2003 Wei ..... 81/63.2
6,629,477 B1 * 10/2003 Ling et al. ..... 81/63.2
6,761,091 B1 * 7/2004 Hsien ..... 81/63.2
6,886,428 B1 * 5/2005 Hsien ..... 81/63.2
6,935,213 B1 * 8/2005 Shu-Sui et al. ..... 81/63.2
6,945,141 B1 * 9/2005 Hu ..... 81/63.2
6,959,626 B1 * 11/2005 Shen ..... 81/63.2
2001/0035074 A1 * 11/2001 Hu ..... 81/63
2002/0194965 A1 * 12/2002 Chen ..... 81/63
2006/0027050 A1 * 2/2006 Hsien ..... 81/63.2

* cited by examiner

*Primary Examiner*—Lee D. Wilson

(57) ABSTRACT

A bi-directional ratchet spanner with a ratchet control structure includes a first receiving portion for receiving a ratchet; a second receiving portion for receiving a braking block; and a third receiving portion for receiving a switch unit. The wall of the third receiving portion has a first trench and a second trench. One end of the switch unit in the third receiving portion is formed with a concave portion and a through hole. The concave portion receives one end of a positioning rod. Another end of the positioning rod is received in a sliding trench of the braking block; and a control element is received in the through hole. By moving the switch unit, the positioning rod and control element will control the rotation direction of the ratchet. The conductive wire includes a steel ball, a spring and a top rod.

4 Claims, 5 Drawing Sheets

RATCHET CONTROL STRUCTURE OF BIDIRECTIONAL RATCHET SPANNER

FIELD OF THE INVENTION

The present invention relates to ratchet spanner, and particular to a ratchet spanner with a ratchet control structure, wherein the ratchet control structure has a switch unit which includes a control element. When adjusting the switch unit, a positioning rod is moved to drive the braking block so as to adjust the rotation direction of the spanner.

BACKGROUND OF THE INVENTION

In the prior art bi-directional ratchet spanner has a head and a handle. The head and handle are formed with respective recesses. A braking block is received in the recess of the head and a wing portion of a switch unit is received in the recess of the handle. A lower end of the wing portion is formed with a positioning block. One end of the positioning block is received in a groove of the braking block. By moving the switch unit, the positioning block is driven so as to drive the braking block and thus the direction of the ratchet can be changed.

In the prior art the recess is small and thus the switch unit is also small so that the whole spanner has a strong structure. As a result the user must apply a great force to move the switch unit so that the user's fingers will feel ache.

In another improvement, the head and handle are formed with respective recesses. The head is formed with a via hole for receiving a post-like direction change switch. The switch is formed with a trumpet groove. A thicken driving block can be buckled in the groove so as to change the direction of the braking block and ratchet.

However, above mentioned prior art has the following disadvantages.

The switch unit is thick so as to weaken the structure. Thereby, the groove makes the strength of the head decrease dramatically. Thus, it is not suitable to rotate a rusted screwing element.

Moreover, the post-like direction change switch and the driving block are separated. However, if the manufacturing errors will cause that the operation cannot be performed accurately. Moreover, the trumpet like groove and the recess will make the manufacturing process becomes complicated. Finally, as the above mentioned spanner, the recesses are formed at weak portions of the structure so that the structure is further weakened.

SUMMARY OF THE INVENTION

Accordingly, the primary object of the present invention is to provide a ratchet control structure, wherein the ratchet control structure has a switch unit which includes a control element. When adjusting the switch unit, a positioning rod is moved to drive the braking block so as to adjust the rotation direction of the spanner.

To achieve above objects, the present invention provides a bi-directional ratchet spanner with a ratchet control structure which comprises a first receiving portion for receiving a ratchet; a second receiving portion for receiving a braking block; and a third receiving portion for receiving a switch unit. The wall of the third receiving portion has a first trench and a second trench. One end of the switch unit in the third receiving portion is formed with a concave portion and a through hole. The concave portion receives one end of a positioning rod. Another end of the positioning rod is received in a sliding trench of the braking block; and a control element is received in the through hole. By moving the switch unit, the positioning rod and control element will control the rotation direction of the ratchet. The conductive wire includes a steel ball, a spring and a top rod.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
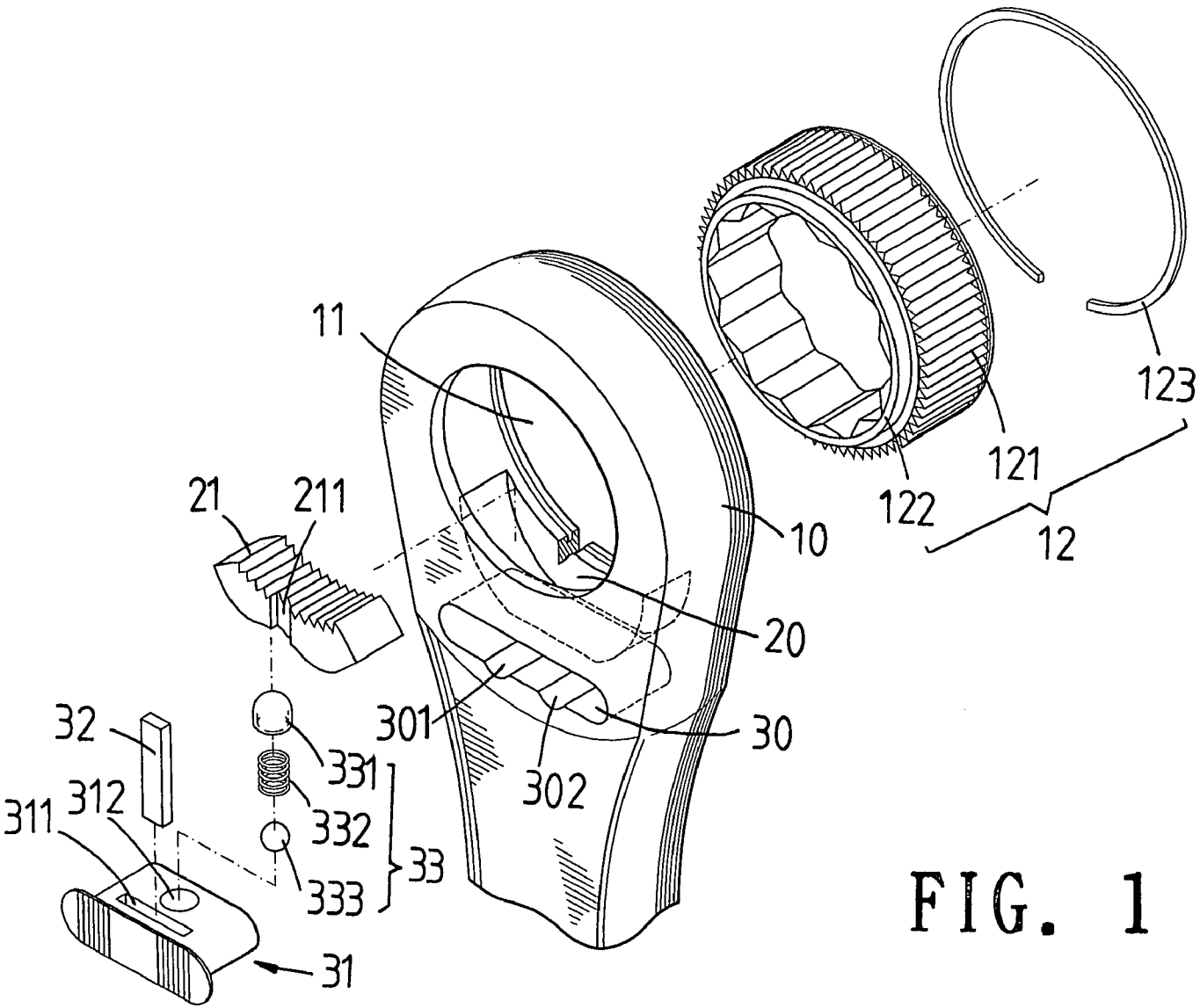
FIG. 1 is an exploded schematic view of the ratchet control structure of the present invention.
Figure 2:
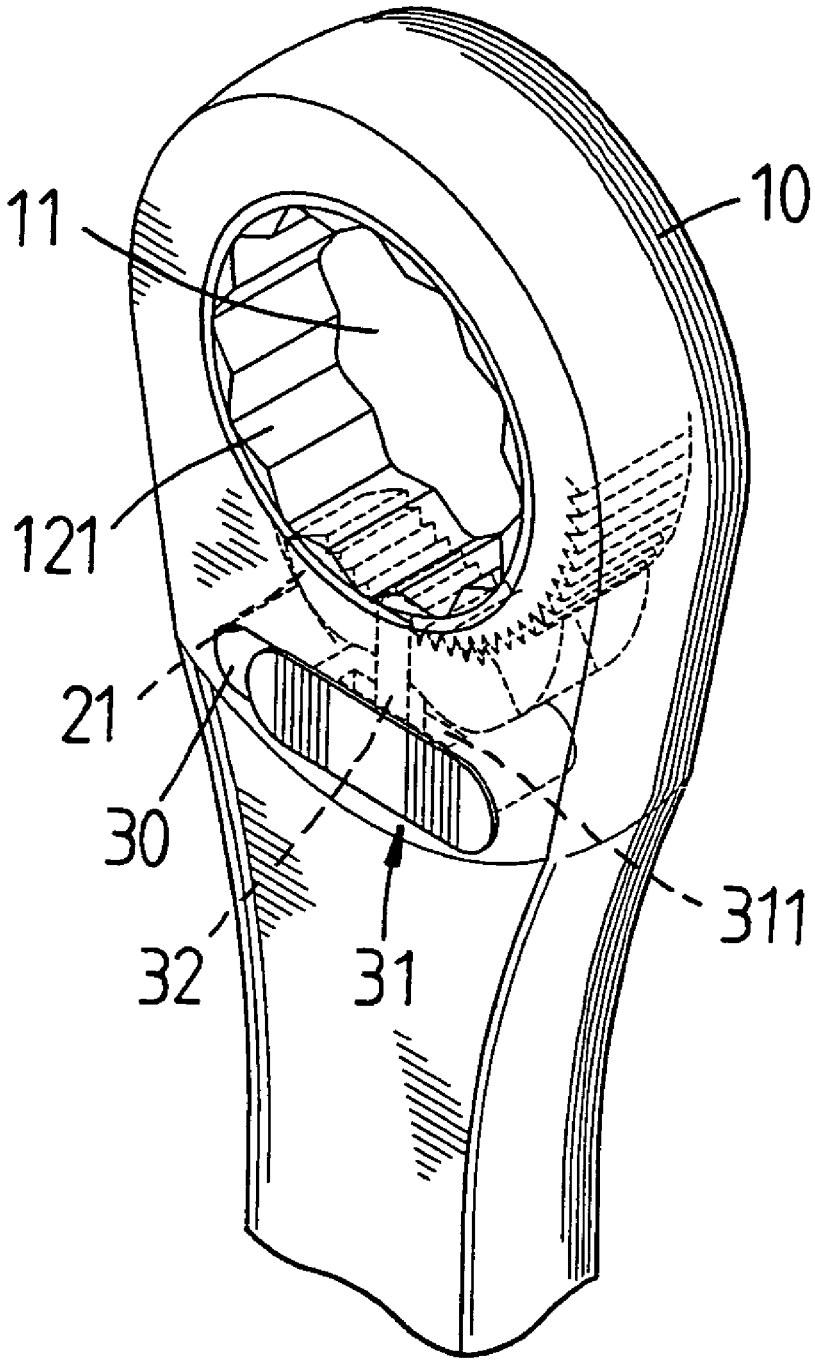
FIG. 2 is an assembled view of the ratchet control structure of the present invention.
Figure 3:
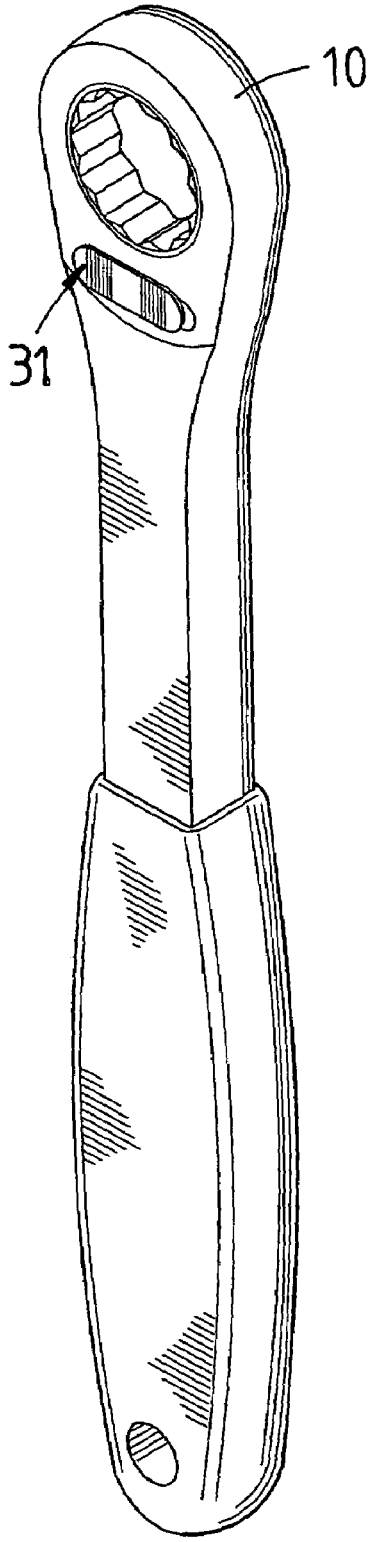
FIG. 3 is a schematic perspective view of the ratchet control structure of the present invention.

With reference to FIGS. 1 to 3, the ratchet control structure of the present invention is illustrated. The control structure has the following elements.

A head portion 10 has a first receiving portion 11, a second receiving portion 20 and a third receiving portion 30. The first receiving portion 11 serves to receive a ratchet unit 12. The ratchet unit 12 includes a ratchet 121 and a C ring 123. When the ratchet 121 is received in the first receiving portion 11, the C ring 123 is installed to an edge 122 of the ratchet 121 so that when the ratchet 121 is received in the first receiving portion 11, the ratchet can rotate stable.

The second receiving portion 20 is communicable with the first receiving portion 11 and third receiving portion 30. A braking block 21 is received within the second receiving portion 20. The braking block 21 has a cambered shape. A top center of the braking block 21 is formed with a sliding trench 211 for receiving one end of a positioning rod 32. A surface of the braking block 21 without ratchet teeth is formed with a concave section (not shown) for resisting against a control element 33. Furthermore, the second receiving portion 20 has a sufficient space for sliding the braking block 21 so that the braking block 21 can selectively buckle the ratchet 121 for changing the direction of spanner.

The third receiving portion 30 serves for receiving a switch unit 31. The switch unit 31 has a concave portion 311 and a through hole 312. The concave portion 311 serves to receive another end of the positioning rod 32 so as to prevent the braking block 21 to vibrate to separate from the third receiving portion 30.

The switch unit 31 of the third receiving portion 30 receives a control element 33 for changing direction. The control element 33 includes a steel ball 333, a connecting spring 332 and a ballet like top rod 331. By the control element 33 in the through hole 312, the positioning rod 32 can drive the braking block 21 to change direction.

Furthermore, one lateral wall of the third receiving portion 30 is formed with a first trench 301 and a second trench 302 for receiving the steel ball 333 in the through hole 312 of the switch unit 31 as the switch unit 31 is in change direction operation so as to enhance the engagement of the braking block 21 and the ratchet 121.

Figure 5:
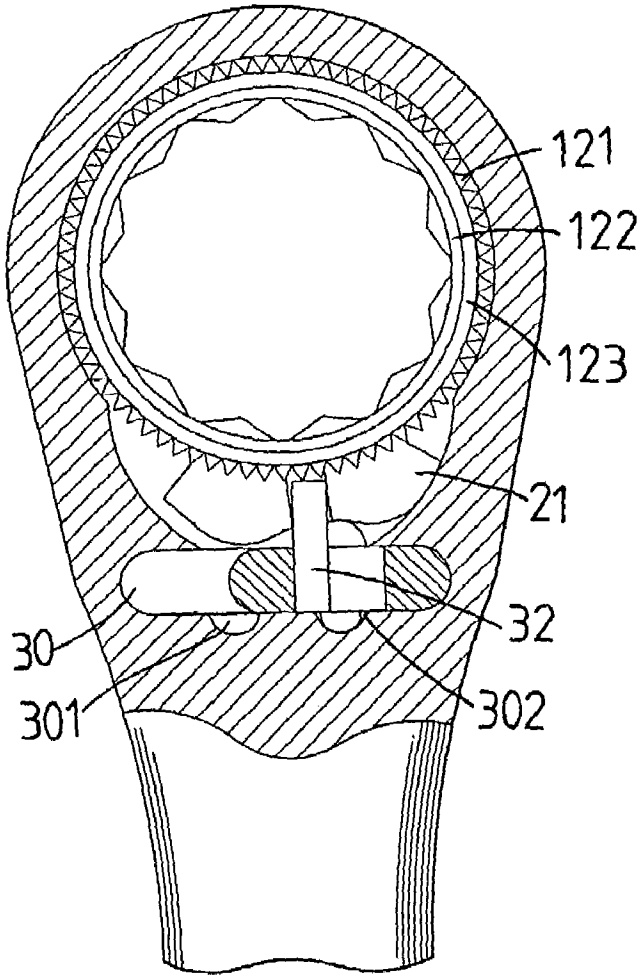
FIGS. 4 and 5 show the operation of the ratchet control structure of the present invention.
Figure 4:
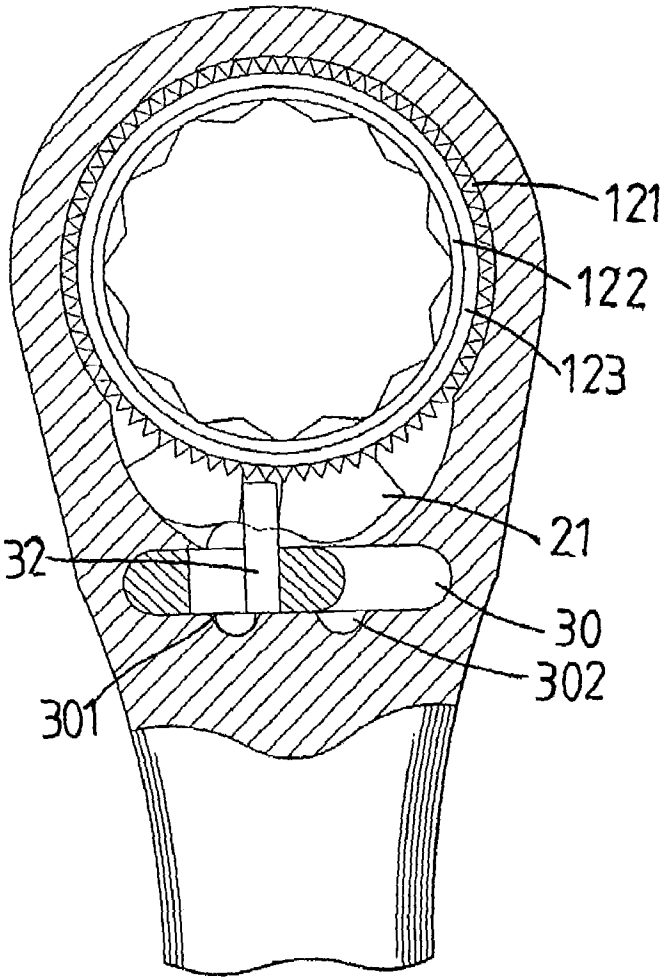

With reference to FIG. 4, when the switch unit 31 is moved to be above the first trench 301, the switch unit 31 will drive the control element 33 and the positioning rod 32 so that the ratchet 121 is positioned leftwards and thus the ratchet 121 is confined to move leftwards. Moreover, referring to FIG. 5, when the switch unit 31 is moved to be above the second trench 301, the control element 33 and the positioning rod 32 will move the ratchet 121 rightwards so as to be confined to move rightwards.

Thereby, by above design of the switch unit 31, a large stress from manual operation will be avoided. Meanwhile, the third receiving portion 30 for receiving the switch unit 31 is installed at a head portion 10 instead being at the connection of the head portion 10 and handle. Thereby, it does not destroy the structure of the spanner.

Figure 7:
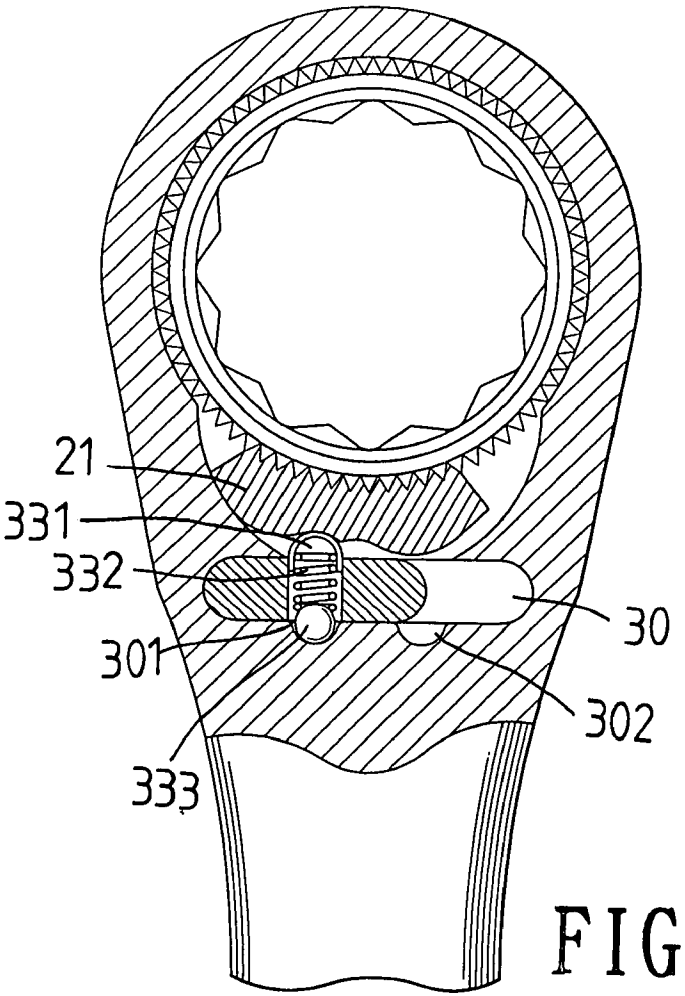
FIGS. 6 and 7 is a cross section view about the operation of the ratchet control structure of the present invention.
Figure 6:
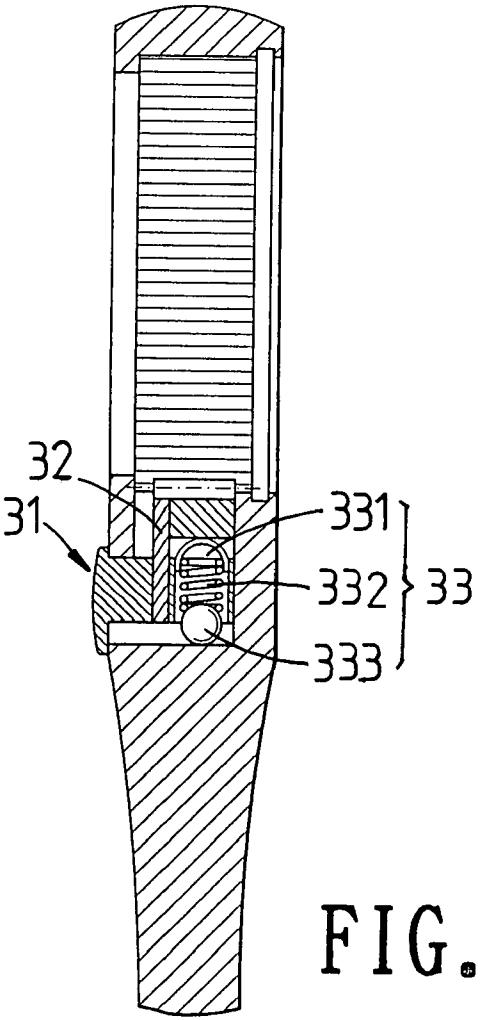

Referring to FIGS. 6 and 7, when the control element 33 is received in the switch unit 31, one side of the steel ball 333 is placed in the first trench 301 or the second trench 302. By the compression of the spring 332, the top rod 331 can resist against the braking block 21 so as to control the braking block 21 effectively. Thereby, the object of stable control is achieved.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A bi-directional ratchet spanner with a ratchet control structure, comprising:

a ratchet unit;

a handle;

a first receiving portion for receiving the ratchet;

a second receiving portion; a braking block being received in the second receiving portion;

a third receiving portion; a switch unit being received in the third receiving portion; wherein a wall of the third receiving portion has a first trench and a second trench; one end of the switch unit in the third receiving portion is formed with a concave portion and a through hole; the concave portion receives one end of a positioning rod; another end of the positioning rod is received in a sliding trench of the braking block; and a control element is received in the through hole; and wherein by moving the switch unit, the positioning rod and control element will control the rotation direction of the ratchet.

2. The bi-directional ratchet spanner as claimed in claim 1, wherein the conductive wire includes a steel ball, a spring and a top rod.

3. A bi-directional ratchet spanner with a ratchet control structure, comprising:

a handle;

a head portion having a ratchet;

a C ring;

a first receiving portion for receiving the ratchet and the C ring;

a second receiving portion being communicable with the first receiving portion and third receiving portion; a braking block being received within the second receiving portion; the braking block having a cambered shape; a top center of the braking block being formed with a sliding trench for receiving one end of a positioning rod; a surface of the braking block having no ratchet teeth is formed with a concave section for resisting against a control element; and a third receiving portion for receiving a switch unit and a control unit; the switch unit having a concave portion and a through hole; the concave portion receiving another end of the positioning rod; the control element serving for changing direction; by the control element in the through hole, the positioning rod can drive the braking block to change direction; a lateral wall of the third receiving portion being formed with a first trench and a second trench.

4. The bi-directional ratchet spanner as claimed in claim 3, wherein the conductive wire includes a steel ball, a spring and a top rod; the first trench and the second trench serves for receiving the steel ball as the switch unit is in change direction operation so as to enhance the engagement of the braking block and the ratchet.

* * * * *